US011078902B2

(12) United States Patent
Yoshimura

(10) Patent No.: US 11,078,902 B2
(45) Date of Patent: Aug. 3, 2021

(54) ADAPTER PLATE WITH HEAT EXCHANGER FOR A PUMP AND MOTOR

(71) Applicant: Parker-Hannifin Corporation, Cleveland, OH (US)

(72) Inventor: Steven Yoshimura, Torrance, CA (US)

(73) Assignee: Parker-Hannifin Corporation, Cleveland, OH (US)

( * ) Notice: Subject to any disclaimer, the term of this patent is extended or adjusted under 35 U.S.C. 154(b) by 239 days.

(21) Appl. No.: 15/993,657

(22) Filed: May 31, 2018

(65) Prior Publication Data

US 2019/0055938 A1 Feb. 21, 2019

Related U.S. Application Data

(60) Provisional application No. 62/546,118, filed on Aug. 16, 2017.

(51) Int. Cl.

| | |
|---|---|
| ***F04B 53/08*** | (2006.01) |
| ***F04B 53/16*** | (2006.01) |
| ***F04B 17/03*** | (2006.01) |
| ***F04D 29/58*** | (2006.01) |

(52) U.S. Cl.

CPC ..... *F04B 53/08* (2013.01); *F04B 17/03* (2013.01); *F04B 53/16* (2013.01); *F04D 29/586* (2013.01)

(58) Field of Classification Search

CPC ..... F04B 17/03; F04B 53/08; F04B 53/16; F04D 29/5866; F04D 29/5893; F28F 7/02; F28F 2250/08

See application file for complete search history.

(56) References Cited

U.S. PATENT DOCUMENTS

| | | | | |
|---|---|---|---|---|
| 2,239,228 A * | 4/1941 | Hankison | F04D 7/06 415/180 |
| 3,303,870 A * | 2/1967 | Newman | F28F 19/00 159/27.2 |
| 3,478,689 A * | 11/1969 | Ball | F04D 29/061 417/373 |
| 3,485,177 A * | 12/1969 | Clay | F04D 29/186 417/420 |
| 5,599,164 A * | 2/1997 | Murray | F04D 13/14 415/144 |
| 6,200,108 B1 | 3/2001 | Caudill et al. | |
| 7,371,045 B2 | 5/2008 | Patel et al. | |
| 7,569,955 B2 | 8/2009 | Hassett et al. | |

(Continued)

FOREIGN PATENT DOCUMENTS

EP 0 990 800 A1 4/2000

*Primary Examiner* — Nathan C Zollinger

(74) *Attorney, Agent, or Firm* — Renner, Otto, Boisselle & Sklar, LLP

(57) ABSTRACT

A pump assembly includes a pump having a fluid inlet and a fluid outlet, and an electric motor having a drive mechanism that is connected to the pump mechanism. The assembly includes an adapter plate having an inlet port, an outlet port, and at least one fluid passage between the inlet port and the outlet port. The at least one fluid passage is at least partially defined by the adapter plate. The motor is thermally coupled to the adapter plate and the fluid outlet of the pump is fluidly connected to the inlet port of the adapter plate. The pump is configured to pump fluid through the at least one fluid passage of the adapter plate, and the adapter plate is configured to discharge the fluid.

19 Claims, 8 Drawing Sheets

(56) References Cited

U.S. PATENT DOCUMENTS

| | | | | |
|---|---|---|---|---|
| 7,802,614 | B2 * | 9/2010 | Einar | H02K 9/22 165/46 |
| 2018/0023565 | A1 * | 1/2018 | Wang | F04C 15/06 417/53 |

* cited by examiner

ADAPTER PLATE WITH HEAT EXCHANGER FOR A PUMP AND MOTOR

This application claims priority to U.S. Provisional Patent Application No. 62/546,118 filed Aug. 16, 2017, which is hereby incorporated herein by reference.

FIELD OF INVENTION

The present invention relates to pump and motor assemblies, and more particularly to a cooling device for cooling the motor during operation.

BACKGROUND

Various applications use a pump assembly that has a continuously operating motor. One application for a pump assembly having a continuously operating motor is a water purifying system that pumps contaminated water to a filtration system. The motor runs continuously and requires constant cooling to ensure efficient operation of the motor. Conventional motors use airflow to cool the motors. However, using airflow to cool the motors may be disadvantageous in certain applications in which the motor is contained in a sealed enclosure, such as in a portable water purification assembly. In an application in which the motor is enclosed, complete sealing of the pump and motor enclosure may be unachievable since airflow cooling of the motor requires fans, air flow paths, and other airflow cooling mechanisms. The need for open air passages in an enclosure provides a path for dust, dirt and other contaminates to enter the enclosure interior. Furthermore, using fans and other airflow cooling mechanisms may cause bulkiness of the motor and increase the overall weight of the pump assembly.

SUMMARY OF INVENTION

The present invention is directed towards a pump and motor assembly having an adapter plate that is thermally coupled to the motor. The adapter plate contains fluid passages defined within a face of the adapter plate that receive pumped fluid from the pump and circulate the fluid along the face of the motor housing. The adapter plate is in thermal contact with a large surface area of the motor housing to conduct heat between the motor and the adapter plate and fluid such that the adapter plate functions as a heat exchanger. Using the adapter plate as a heat exchanger is advantageous in that the adapter plate enables complete sealing of the motor. The motor runs continuously without providing a fan or other convective air flow cooling mechanism. Using the motor adapter as a heat exchanger also reduces the heat sink mass and the surface area required for convection cooling.

According to an aspect of the invention, a pump assembly includes a pump having a fluid inlet and a fluid outlet, a motor having a drive mechanism that is connected to the pump mechanism, and an adapter plate having an inlet port, an outlet port, and at least one fluid passage between the inlet port and the outlet port. The at least one fluid passage is at least partially defined by the adapter plate. The motor is thermally coupled to the adapter plate and the fluid outlet of the pump is fluidly connected to the inlet port of the adapter plate, the pump being configured to pump fluid through the at least one fluid passage of the adapter plate, and the adapter plate being configured to discharge the fluid.

According to an aspect of the invention, an open pump system includes an enclosure, a pump arranged within the enclosure, the pump having a pump housing with a fluid inlet and a fluid outlet, and a pump mechanism enclosed by the pump housing, a motor arranged and sealed within the enclosure, the electric motor having a motor housing and a drive mechanism enclosed by the motor housing, wherein the drive mechanism is connected to the pump mechanism; and an adapter plate arranged within the enclosure. The adapter plate has an inlet port, an outlet port, and at least one fluid passage between the inlet port and the outlet port, the at least one fluid passage being at least partially defined by the adapter plate, wherein the motor housing is thermally coupled to the adapter plate. The fluid outlet of the pump is fluidly connected to the inlet port of the adapter plate, and the pump is configured to intake fluid from outside the enclosure through the fluid inlet and pump the fluid through the at least one fluid passage of the adapter plate. The fluid is discharged out of the enclosure from the outlet hose and outlet port of the adapter plate.

According to an aspect of the invention, a method for cooling a motor in a pump and motor assembly includes intaking a flow of fluid through a pump inlet of a pump, discharging at least part of the flow of fluid through a pump outlet of the pump, pumping the at least part of the flow of fluid through a fluid passage defined in an adapter plate that is fluidly connected to the pump outlet, wherein the adapter plate is in thermal contact with a motor housing that contains the motor, and discharging the at least part of the flow of fluid through a discharge passage defined in the adapter plate.

Other systems, devices, methods, features, and advantages of the present invention will be or become apparent to one having ordinary skill in the art upon examination of the following drawings and detailed description. It is intended that all such additional systems, methods, features, and advantages be included within this description, be within the scope of the present invention, and be protected by the accompanying claims.

DETAILED DESCRIPTION

Aspects of the present invention relate to a pump assembly that has a pump, a motor, and an adapter plate that is arranged between the pump and the motor to cool the motor. The adapter plate has fluid passages defined in the face of the adapter plate that allow water flowing through the pump to also flow through the adapter plate and along a face of the motor housing. The pump assembly may be suitable for use in many applications. For example, the pump assembly may be suitable for use in a water purifying system implemented in a body of water, such as a freshwater stream or pond. In an exemplary application, the pump assembly may be part of a water purifying system that uses reverse osmosis for filtration.

Figure 1:
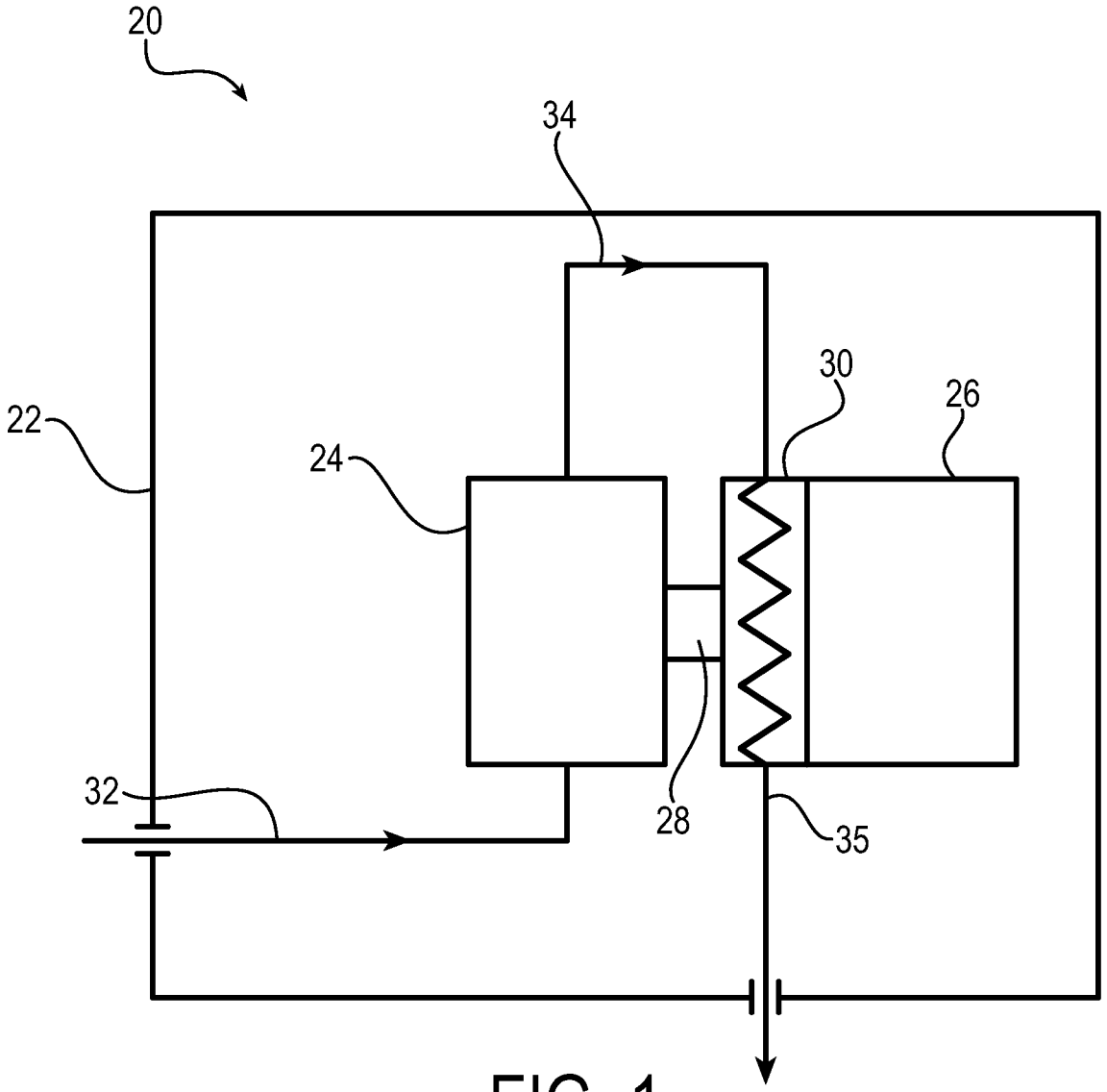
FIG. 1 is a schematic drawing showing a pump assembly.

Referring first to FIG. 1, a schematic drawing of a pump assembly 20 is shown. The pump assembly 20 includes an enclosure 22 containing a pump 24 and a motor 26 that is connected to the pump 24 with a connecting shaft 28. The enclosure 22 may be a suitable casing or container for placement near a contaminated body of water. The motor 26 may be any suitable motor, such as a DC motor and more particularly, a brushless DC motor. The pump assembly 20 further includes an adapter plate 30 that is thermally coupled to the motor 26 and fluidly connected to the pump 24. The pump 24 includes an intake line 32 arranged at one end of the pump 24 that may be a suction line, and a discharge line 34 arranged opposite the intake line 32. The discharge line 34 is in fluid communication with the adapter plate 30.

The pump 24 intakes fluid from outside the enclosure 22, such as contaminated water, and discharges at least a portion of the fluid to the adapter plate 30. The adapter plate 30 has at least one fluid passage defined in the face of the adapter plate 30 (not shown in FIG. 1) such that the fluid flows through the adapter plate 30 and along a surface of the motor housing to cool the motor 26. Using the adapter plate allows proper heat conduction for the motor 26 such that the motor runs continuously without providing a fan or other airflow cooling device. The fluid is discharged from the adapter plate 30 through a plate discharge line 35. The pumped fluid may be discharged to a filtration system (not shown) for filtering the fluid. Accordingly, the pump assembly 20 uses the pumped fluid to cool the motor 26.

Figure 2:
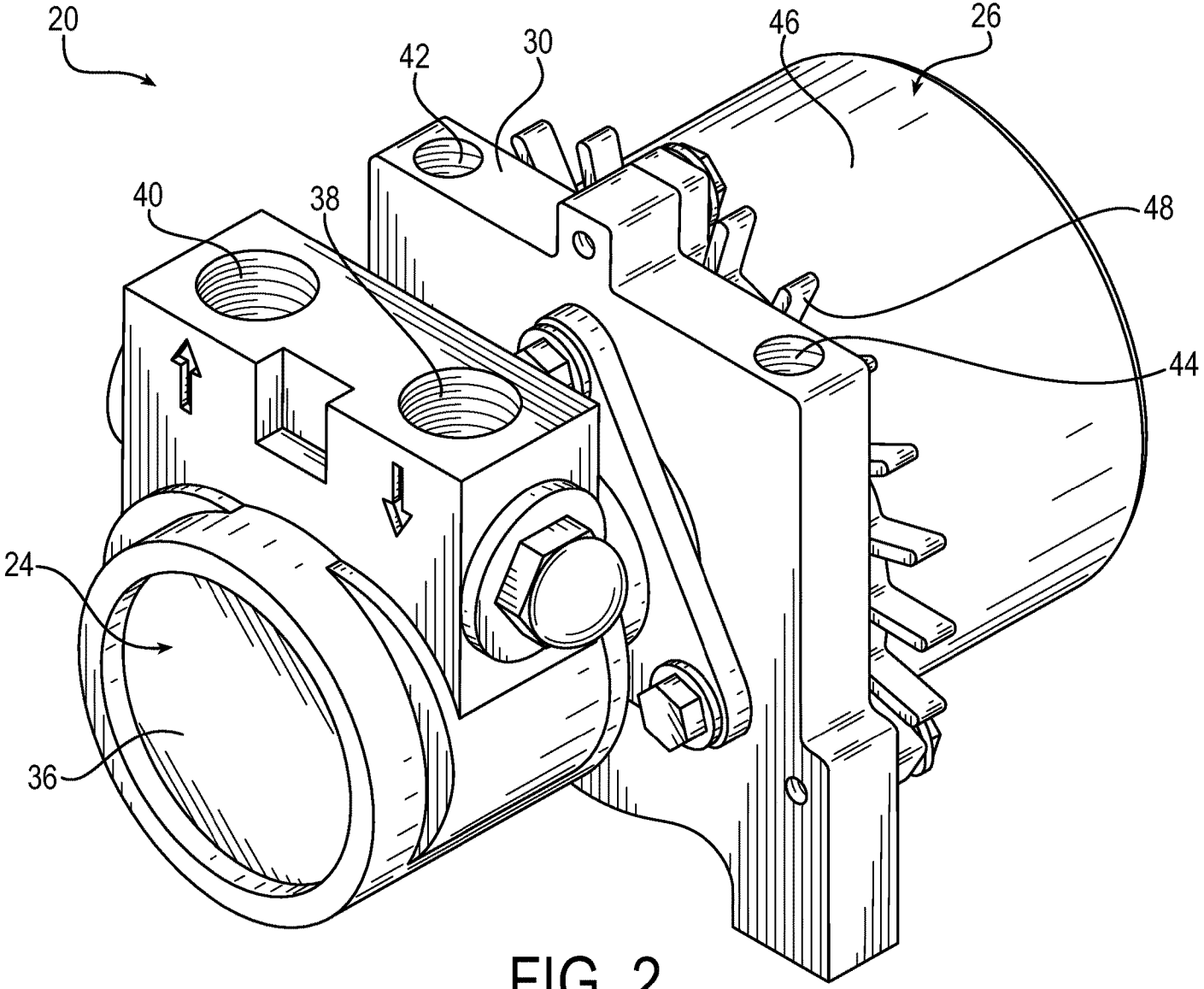
FIG. 2 is a schematic drawing showing an isometric view of the pump assembly shown in FIG. 1.

Referring now to FIG. 2, a schematic drawing of an isometric view of the pump assembly 20 is shown. The pump assembly 20 includes a pump housing 36 that contains the pump 24 and has a fluid inlet or inlet port 38, and a fluid outlet or outlet port 40. The fluid inlet 38 and the fluid outlet 40 may be threaded for receiving a hose fitting and connection to other fluid lines. The fluid inlet 38 is in fluid communication with the intake line 32 (shown in FIG. 1). The fluid outlet 40 may be in fluid communication with a filtration system, or the fluid outlet 40 may be in fluid communication with the adapter plate 30. The adapter plate 30 includes a plate fluid inlet or plate inlet port 42 and a plate fluid outlet or plate outlet port 44. The plate fluid inlet 42 and the plate fluid outlet 44 may also be threaded for receiving a hose fitting and connection with other fluid lines. The plate fluid outlet 44 is in fluid communication with the plate discharge line 35 (shown in FIG. 1). The fluid inlets 38, 42 and the fluid outlets 40, 44 may be configured to be spaced from each other and extend parallel to each other, as shown in FIG. 2.

The plate fluid inlet 42 is in fluid communication with the pump 24 to receive a flow of fluid or a portion of the flow of fluid that is taken in by the pump 24 from the water source. The pump 24 discharges the fluid to the plate fluid inlet 42 of the adapter plate 30, which is adjacent to and in thermal contact with the motor 26. The motor 26 includes a motor housing 46 which contains the motor 26, and the adapter plate 30 is in thermal contact with a corresponding face of the motor housing 46. The motor housing 46 may be formed of any suitable material, such as cast iron or steel. The motor housing 46 further includes a cooling fin 48 that is mounted to the outer peripheral surface of the motor housing 46 adjacent the adapter plate 30. The cooling fin 48 may be formed integrally with the motor housing 46. In still another embodiment, the cooling fin 48 may be arranged on or formed integrally with the adapter plate 30.

Figure 3:
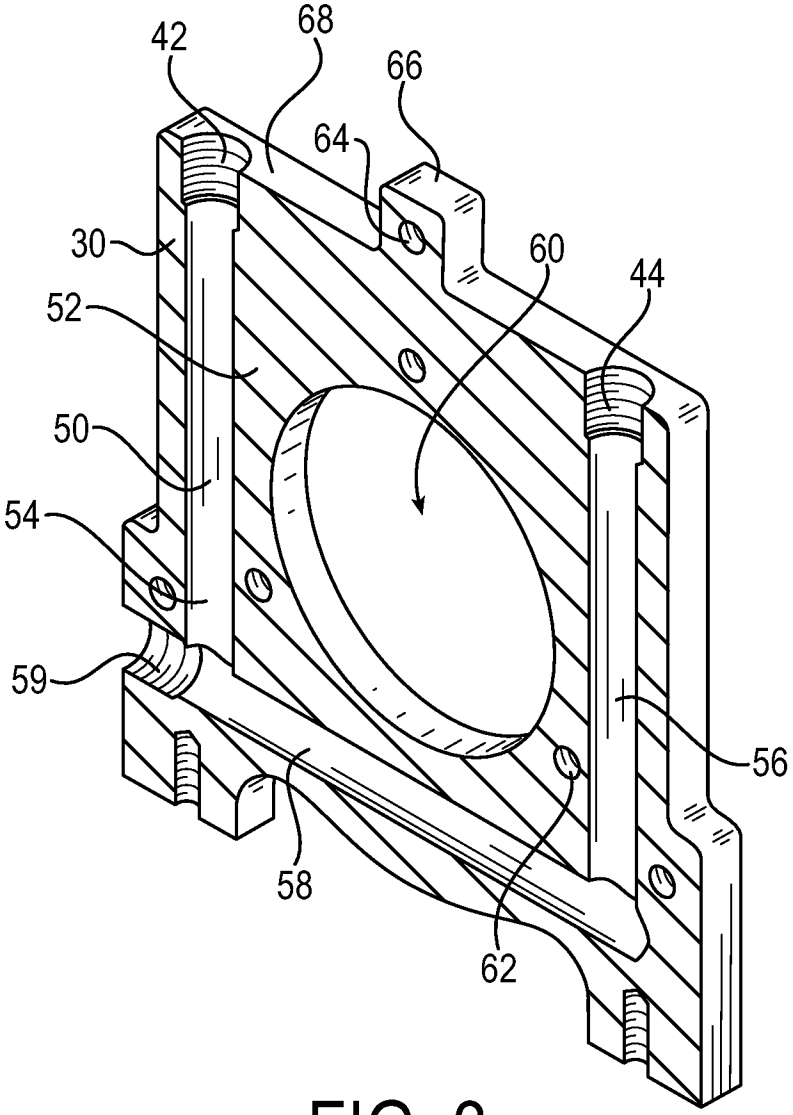
FIG. 3 is a schematic drawing showing an isometric and sectional view of an adapter plate used in the pump assembly shown in FIG. 1.
Figure 4:
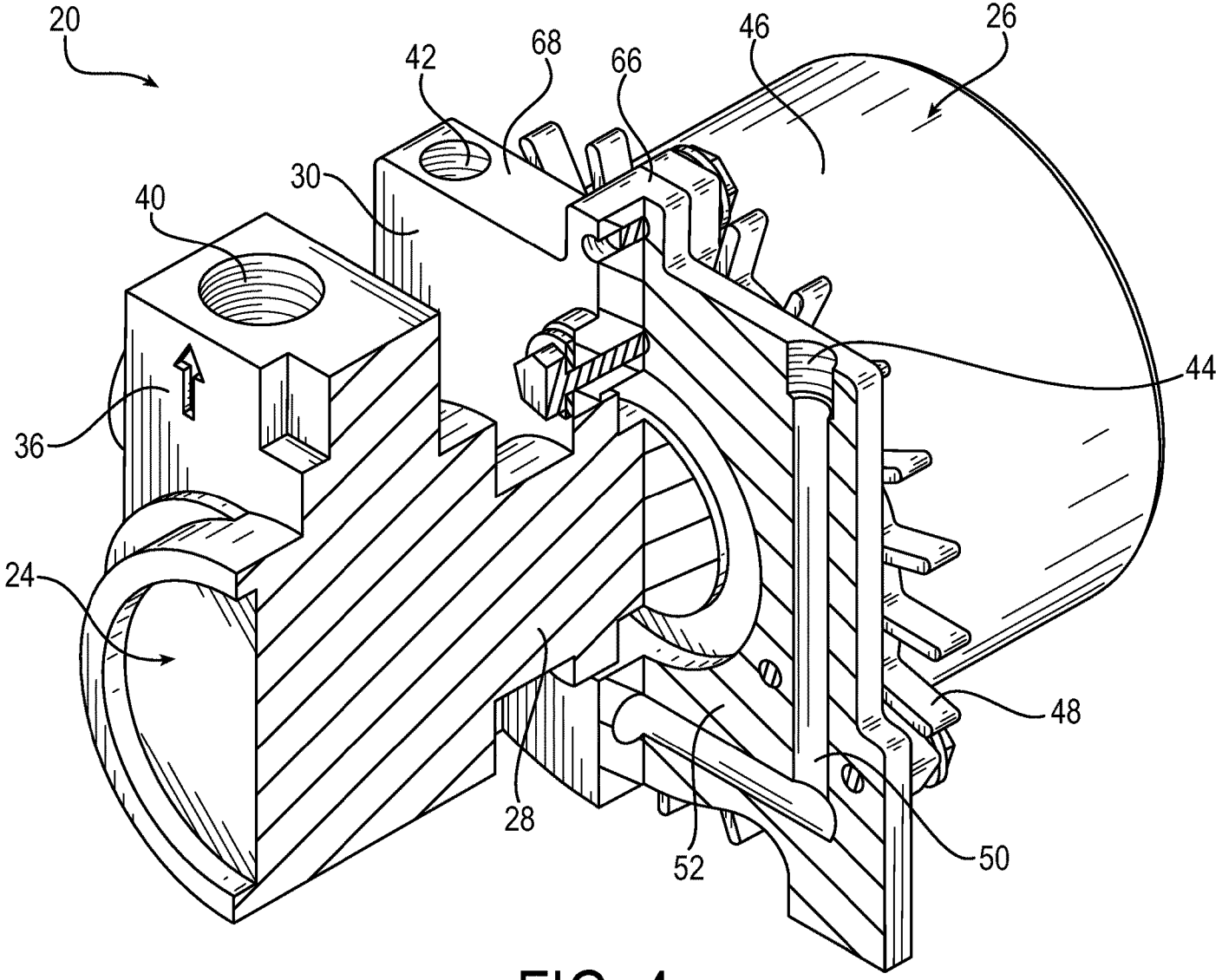
FIG. 4 is a schematic drawing showing an isometric and cross-sectional view of the pump assembly shown in FIG. 1.

Referring in addition to FIGS. 3 and 4, a schematic drawing of an isometric and sectional view of the adapter plate 30 is shown in FIG. 3, and a schematic drawing of an isometric and cross-sectional view of the pump assembly 20 is shown in FIG. 4. The adapter plate 30 may have any suitable shape. For example, the shown adapter plate 30 is rectangular and has a thickness that is significantly less than the length and the height of the adapter plate 30. The thickness of the adapter plate 30 is also significantly less than the length of the pump 24 and the motor housing 46. The adapter plate 30 may be formed by any suitable manufacturing process, and the adapter plate 30 may also be formed of any suitable material, such as a corrosion resistant metal material. Examples of suitable materials include copper or copper nickel, and the material may be dependent on the application. For example, if the pump assembly 20 is arranged in a freshwater application, copper may be suitable.

The pump 24, the motor 26, the cooling fin 48, and the adapter plate 30 are all mounted along a common longitudinal axis, and the adapter plate 30 is used to facilitate mounting the pump 24 to the motor 26. The adapter plate 30 may have at least one fluid passage 50 defined in a first face 52 of the adapter plate 30. The at least one fluid passage 50 may include an inlet fluid passage 54 and an outlet fluid passage 56 that correspond to the fluid inlet 42 and the fluid outlet 44, respectively. The inlet fluid passage 54 and the outlet fluid passage 56 may be cylindrical or have any other suitable shape. The inlet fluid passage 54 and the outlet fluid passage 56 may be straight, as shown in FIG. 3. In other embodiments of the adapter plate 30, the fluid passages may be serpentine. The inlet fluid passage 54 and the outlet fluid passage 56 may extend parallel to each other and may extend in a vertical direction when the adapter plate 30 is mounted to the motor housing 46, as shown in FIG. 4.

The adapter plate 30 further includes a transverse or horizontal channel 58 that extends between the inlet fluid passage 54 and the outlet fluid passage 56. Fluid flows from the inlet fluid passage 54, through the horizontal channel 58, and through the outlet fluid passage 56. The flow path may be unidirectional through the adapter plate 30. The horizontal channel 58 may also be straight such that the at least one fluid passage 50 is generally formed to have a u-shape defined in the first face 52 of the adapter plate 30. The horizontal channel 58 may be formed to have a threaded end 59 that receives a plug (not shown). The threaded end 59 may be used to facilitate manufacturing of the adapter plate 30, and the plug may be inserted to close the end of the horizontal channel 58 and close the fluid passage 50 when the pump assembly 20 is assembled. The adapter plate 30 further has a central aperture 60 defined in the plate between the inlet fluid passage 54 and the outlet fluid passage 56. The central aperture 60 is cylindrical and configured to receive the connecting shaft 28 therethrough for mounting the adapter plate 30 to the pump assembly 20, as shown in FIG. 4. The aperture 60 may be complementary in shape to the shape of the motor housing 26.

The adapter plate 30 may be formed with a suitable bolt pattern for mounting the adapter plate 30 to the pump assembly 20 with corresponding bolts. The adapter plate 30 may have a plurality of bolt holes 62 arranged around the diameter of the central aperture 60. Any suitable number of bolt holes 62 may be provided, and at least some of the bolt holes 62 may be equidistantly spaced around the central aperture 60. For example, three bolt holes 62 may be arranged around the diameter of the central aperture 60, as shown in FIG. 3. Another one of the bolt holes 64 may be arranged on a stepped protrusion 66 formed on an outer peripheral surface 68 of the adapter plate 30.

Figure 5:
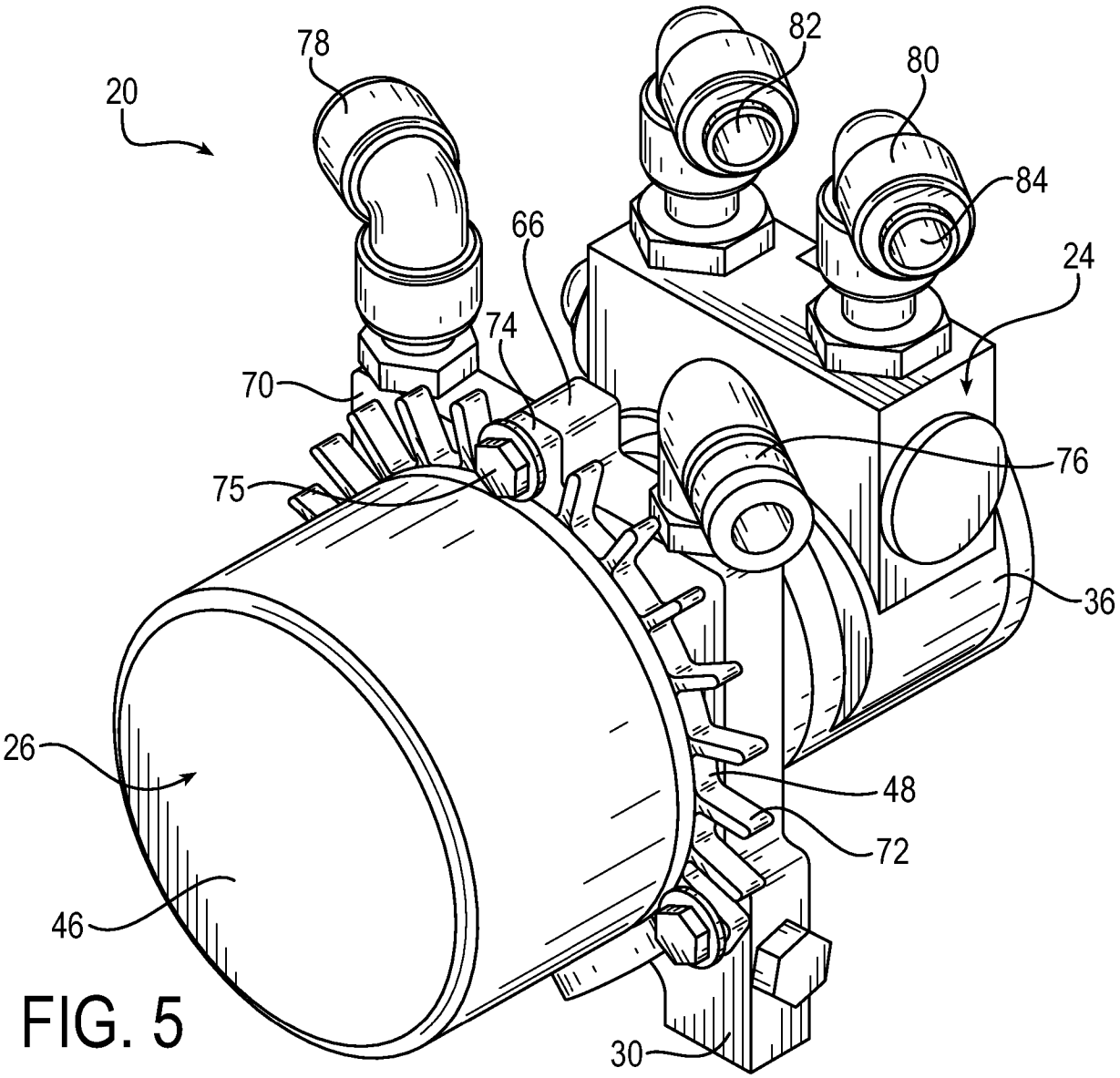
FIG. 5 is a schematic drawing showing an isometric view of the pump assembly shown in FIG. 1 and additionally showing hose fittings.
Figure 6:
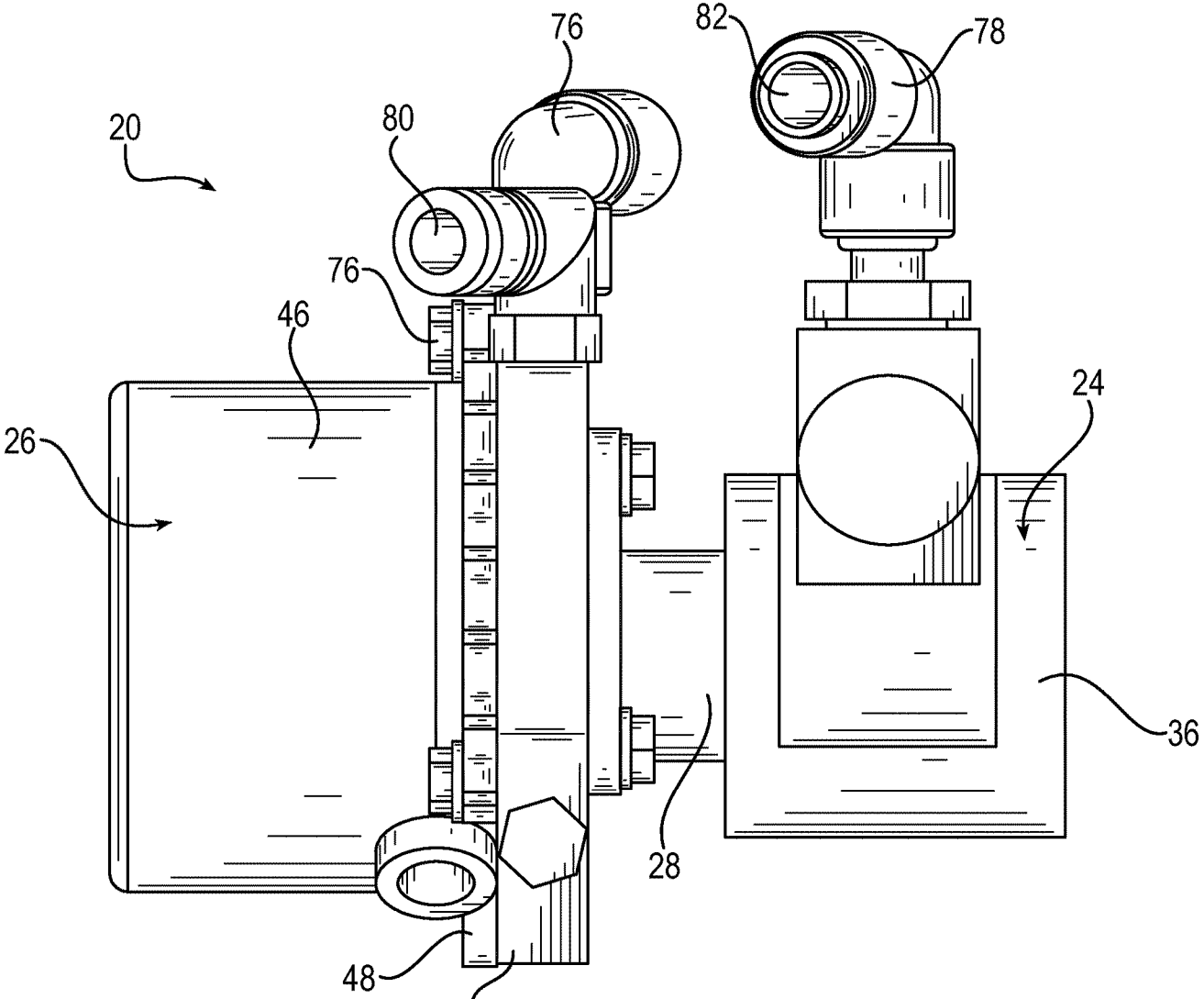
FIG. 6 is a schematic drawing showing a side view of the pump assembly shown in FIG. 5.

Referring in addition to FIGS. 5 and 6, the adapter plate 30 has a second face 70 opposing the first face 52 that faces the motor 26, as best shown in FIG. 5. The second face 70 is in thermal contact with the motor housing 46. The cooling fin 48 is secured to or formed on the motor housing 46 and has equidistantly spaced fins 72 that protrude outwardly from the motor housing 46. The motor housing 46 may have any suitable shape, and an example of a suitable shape is cylindrical such that the fins 72 protrude radially outwardly from the motor housing 46. The cooling fin 48 may also have rectangular protrusions 74 that protrude radially outwardly from the motor housing 46. Each rectangular protrusion 74 is configured to receive a bolt 75 therethrough. The rectangular protrusion 74 may be complementary in shape to the stepped protrusion 66 such that the face of the rectangular protrusion 74 lies flush against the first face 52 defined by the stepped protrusion 66. The faces of the motor housing 46 and the adapter plate 30 are matingly engageable with each other and the faces may be sealingly engaged with each other.

As shown in FIGS. 5 and 6, the pump assembly 20 further includes fittings 76, 78, 80, 82 that are connected to the inlet ports and the outlet ports of the adapter plate 30 and the pump 24. The fittings 76, 78, 80, 82 may extend in a direction normal to the common longitudinal axis of the pump assembly 20. The pump assembly 20 includes fittings 76, 78 that are connected to the inlet port and the outlet port of the adapter plate 30, and fittings 80, 82 that are connected to the inlet port and the outlet port of the pump 24. The fittings 76, 78, 80, 82 each have hose-receiving ends 84 that are configured to receive the end of a hose member (not shown in FIGS. 5 and 6). The fitting 76, 78, 80, 82 may have threaded ends for threaded connection with the inlet ports and the outlet ports and the hoses. Any suitable fittings, combination of fittings, or hoses may be used, and the fittings and hoses used may be dependent on the application. Examples of suitable fittings include crimped, pipe threads, flared, face seal, adapters, compression, plug-in, push to connect, and union.

Figure 7:
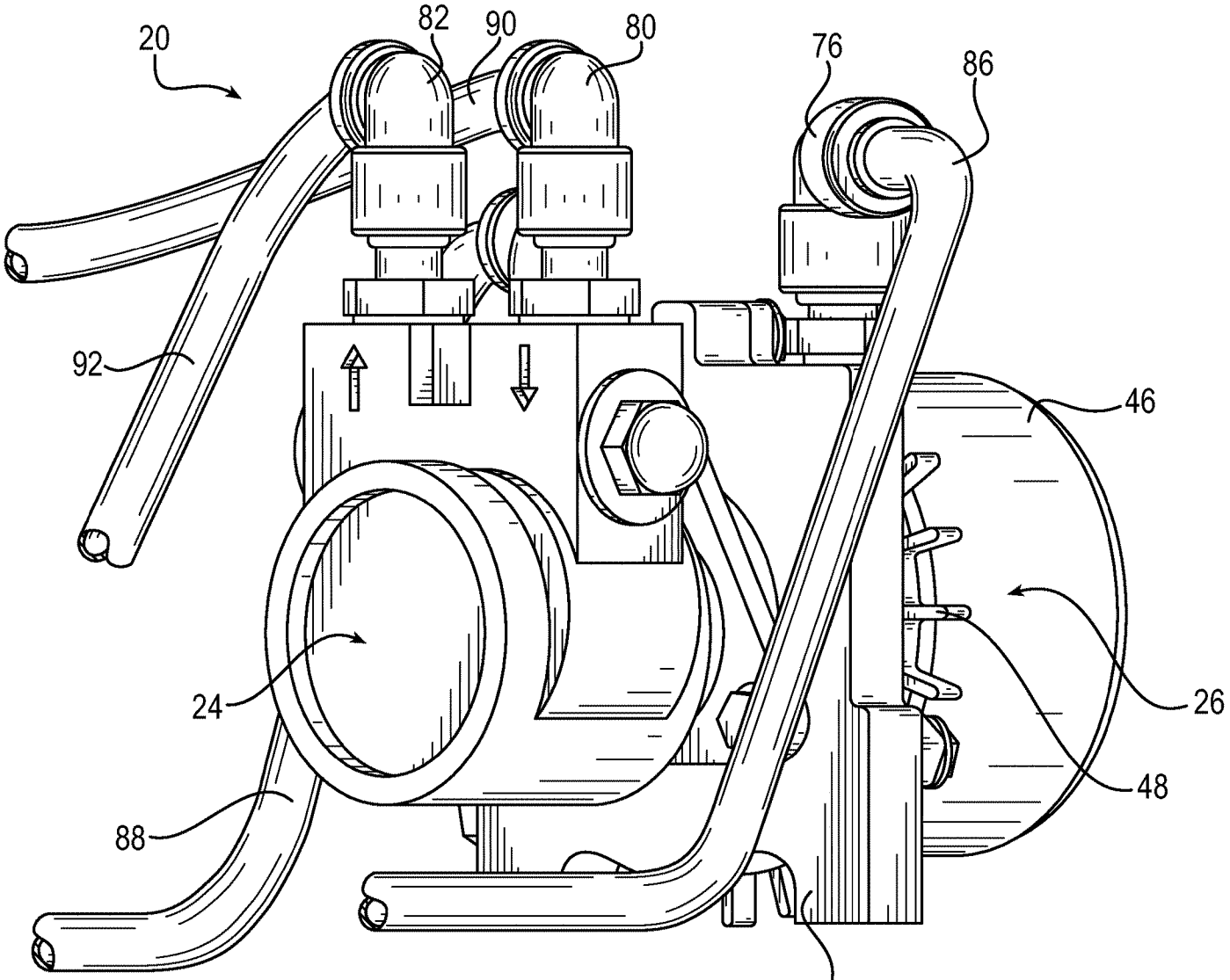
FIG. 7 is a schematic drawing showing a front view of the pump assembly shown in FIG. 1 and additionally showing hoses.
Figure 8:
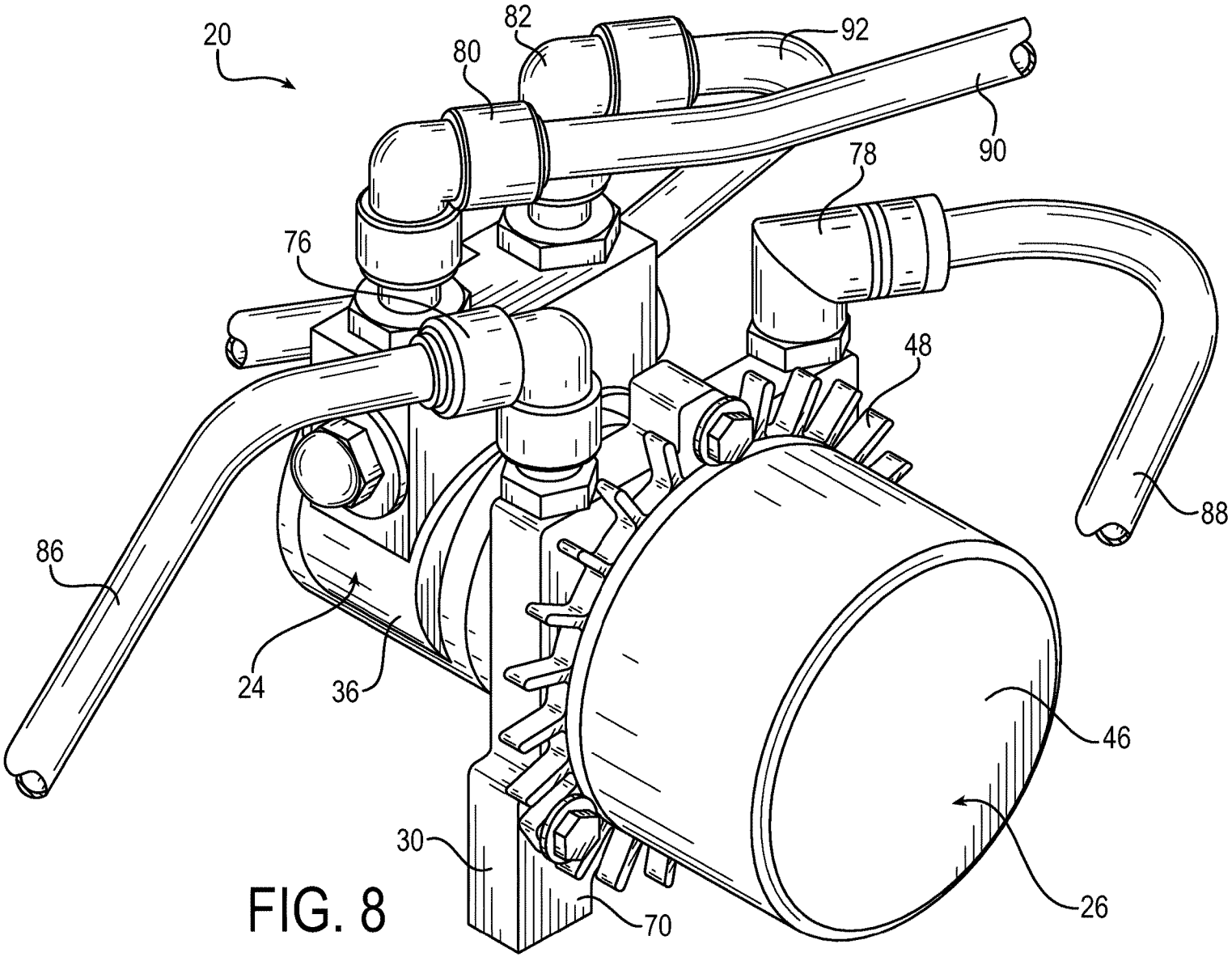
FIG. 8 is a schematic drawing showing a back view of the pump assembly shown in FIG. 7.

Referring in addition to FIGS. 7 and 8, the pump assembly 20 further includes hoses 86, 88, 90, 92 that are connected to the fittings 76, 78, 80, 82. Each hose 86, 88, 90, 92 is connected to a corresponding fitting 76, 78, 80, 82. The hose 86 is connected to the fitting 76 of the adapter plate 30 and the hose 88 is connected to the fitting 78 of the adapter plate 30. The fitting 76 may be associated with the inlet port of the adapter plate 30 and the fitting 78 may be associated with the outlet port of the adapter plate 30. Alternatively, the fitting 76 may be associated with the outlet port of the adapter plate 30 and the fitting 78 may be associated with the inlet port of the adapter plate 30. The hose 90 is connected to the fitting 80 that is connected to the inlet port of the pump 24. The hose 90 may be configured to intake fluid from the water source outside of the enclosure 22 (shown in FIG. 1). The hose 92 is connected to the fitting 82 that is connected to the outlet port of the pump 24. Alternatively, the fitting 80 may be associated with the outlet port of the pump 24 and the fitting 82 may be associated with the inlet port of the pump 24.

During operation, fluid is taken in through the hose 90 and through the inlet port of the pump 24. In an application in which the pump assembly 20 is used in a filtration system, the fluid may be contaminated water. The fluid is pumped through the pump 24. Some of the fluid may be discharged by the pump 24 through the fitting 82 and the hose 92, or the hose 92 may be fluidly connected to the fluid inlet of the adapter plate 30 or another hose associated with the fluid inlet of the adapter plate 30. The hose 92 may be connected to the hose 86 associated with the fluid inlet of the adapter plate 30. The pump 24 discharges some of the fluid flow to the fluid inlet of the adapter plate 30. The fluid is taken in through the hose 86 and the fitting 76 and is received within the fluid passage 50 (as shown in FIG. 3) of the adapter plate 30. The fluid flows through the fluid passage 50 and is discharged from the adapter plate 30 through the fitting 78 and the hose 88. The fluid may be discharged out of the enclosure or toward a filtration system.

The adapter plate 30 is in direct thermal contact with the motor housing 46 such that the adapter plate 30 acts as a heat exchanger for the motor 26 and provides cooling. The surface area of the adapter plate 30 contacts a large surface area of the motor housing 46 to enable proper heat conduction during operation of the motor 26 within the motor housing 46. The motor housing 46 has a circumferential face that directly contacts the adapter plate 30. The adapter plate 30 may be configured to cover a large surface area of the face of the motor housing 46. The adapter plate 30 may cover more than half of an entire area of the face of the motor housing 46 that faces the adapter plate 30. As shown in FIGS. 5-8, the adapter plate 30 covers the entire area of the face of the motor housing 46 and the cooling fin 48 extends outwardly from the motor housing 46 and past the outer peripheral surface 68 of the adapter plate 30.

Using the adapter plate 30 is advantageous for various applications in which the pump assembly 20 is arranged in an enclosure. The adapter plate 30 facilitates mounting of the pump 24 and the motor 26 and uses the water that is already being pumped to a filtration system, such as a reverse osmosis system, to cool the motor 26 and enable continuous operation of the motor 26. The overall weight of the pump assembly 20 may also be reduced due to the elimination of fans, cooling paths, and other cooling components for cooling the motor 26. For example, the entire pump assembly 20 may weigh less than ten pounds as compared with conventional air-cooled motors that weigh over twenty pounds.

A pump assembly includes a pump having a fluid inlet and a fluid outlet, a motor having a drive mechanism that is connected to the pump mechanism, and an adapter plate having an inlet port, an outlet port, and at least one fluid passage between the inlet port and the outlet port. The at least one fluid passage is at least partially defined by the adapter plate. The motor is thermally coupled to the adapter plate and the fluid outlet of the pump is fluidly connected to the inlet port of the adapter plate, the pump being configured to pump fluid through the at least one fluid passage of the adapter plate, and the adapter plate being configured to discharge the fluid.

The pump assembly includes a motor housing that contains the motor, and a pump housing that contains the pump. The motor housing is thermally coupled to a first side of the adapter plate and the pump housing is mounted to a second side of the adapter plate that opposes the first side.

The motor housing has a face that engages the adapter plate and the adapter plate covers more than half of an entire area of the face.

The adapter plate may cover the entire area of the face.

The pump assembly may include a cooling fin that is adjacent the adapter plate and the motor housing.

The adapter plate may be bolted to the motor housing.

The motor housing may be formed of cast iron or steel.

The at least one fluid passage may be u-shaped.

The at least one fluid passage includes an inlet fluid passage and an outlet fluid passage that extend parallel to each other, and a transverse fluid passage that connects the inlet fluid passage and the outlet fluid passage.

The adapter plate may be formed of a corrosion resistant material.

The adapter plate may be formed of a copper material.

The adapter plate may be formed of a copper nickel material.

The pump assembly may include an enclosure in which the pump, the motor, and the adapter plate are contained.

An open pump system includes an enclosure, a pump arranged within the enclosure, the pump having a pump housing with a fluid inlet and a fluid outlet, and a pump mechanism enclosed by the pump housing, a motor arranged and sealed within the enclosure, the electric motor having a motor housing and a drive mechanism enclosed by the motor housing, wherein the drive mechanism is connected to the pump mechanism; and an adapter plate arranged within the enclosure. The adapter plate has an inlet port, an outlet port, and at least one fluid passage between the inlet port and the outlet port, the at least one fluid passage being at least partially defined by the adapter plate, wherein the motor housing is thermally coupled to the adapter plate. The fluid outlet of the pump is fluidly connected to the inlet port of the adapter plate, and the pump is configured to intake fluid from outside the enclosure through the fluid inlet hose and pump the fluid through the at least one fluid passage of the adapter plate. The fluid is discharged out of the enclosure from the outlet port of the adapter plate.

The motor housing is thermally coupled to a first side of the adapter plate and the pump housing is mounted to a second side of the adapter plate that opposes the first side.

The motor housing has a face that engages the adapter plate and the adapter plate may cover the entire area of the face.

The open pump system may include a cooling fin that is adjacent the adapter plate and the motor housing.

The at least one fluid passage may be u-shaped.

The at least one fluid passage may include an inlet fluid passage and an outlet fluid passage that extend parallel to each other, and a transverse fluid passage that connects the inlet fluid passage and the outlet fluid passage.

A method for cooling a motor in a pump and motor assembly includes intaking a flow of fluid through a pump inlet of a pump, discharging at least part of the flow of fluid through a pump outlet of the pump, pumping the at least part of the flow of fluid through a fluid passage defined in an adapter plate that is fluidly connected to the pump outlet, wherein the adapter plate is in thermal contact with a motor housing that contains the motor, and discharging the at least part of the flow of fluid through a discharge passage defined in the adapter plate.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A pump assembly comprising:

a pump having a fluid inlet and a fluid outlet;

a motor having a drive mechanism that is connected to the pump;

a motor housing that contains the motor and defines an end face; and an adapter plate having an inlet port, an outlet port, and at least one fluid passage between the inlet port and the outlet port that forms an outlet of the pump assembly separate from the fluid outlet of the pump, the at least one fluid passage being defined by the adapter plate, the adapter plate defining a planar surface in which the at least one fluid passage is formed that engages the end face of the motor housing and extends across the motor whereby the motor is thermally coupled to the adapter plate, and wherein the fluid outlet of the pump is fluidly connected to the inlet port of the adapter plate, the pump being configured to pump fluid through the at least one fluid passage of the adapter plate to circulate the fluid against the end face of the motor housing in a plane that is parallel with the end face of the motor housing for cooling the motor, and the adapter plate being configured to discharge the fluid through the outlet port of the adapter plate and out of the pump assembly.

2. The pump assembly according to claim 1 further comprising a pump housing that contains the pump, wherein the motor housing is thermally coupled to a first side of the adapter plate and the pump housing is mounted to a second side of the adapter plate that opposes the first side.

3. The pump assembly according to claim 1, wherein the adapter plate covers more than half of an entire area of the end face.

4. The pump assembly according to claim 3, wherein the adapter plate covers the entire area of the end face.

5. The pump assembly according to claim 1 further comprising a cooling fin that is adjacent the adapter plate and the motor housing.

6. The pump assembly according to claim 1, wherein the adapter plate is bolted to the motor housing.

7. The pump assembly according to claim 1, wherein the motor housing is formed of cast iron or steel.

8. The pump assembly according to claim 1, wherein the at least one fluid passage is u-shaped.

9. The pump assembly according to claim 8, wherein the at least one fluid passage includes an inlet fluid passage and an outlet fluid passage that extend parallel to each other, and a transverse fluid passage that connects the inlet fluid passage and the outlet fluid passage.

10. The pump assembly according to claim 1, wherein the adapter plate is formed of a corrosion resistant material.

11. The pump assembly according to claim 1, wherein the adapter plate is formed of a copper material.

12. The pump assembly according to claim 11, wherein the adapter plate is formed of a copper nickel material.

13. The pump assembly according to claim 1 further comprising an enclosure in which the pump, the motor, and the adapter plate are contained.

14. An open pump system comprising:

an enclosure;

a pump arranged within the enclosure, the pump having a pump housing with a fluid inlet and a fluid outlet, and a pump mechanism enclosed by the pump housing;

an electric motor arranged and sealed within the enclosure, the electric motor having a motor housing and a drive mechanism enclosed by the motor housing, wherein the drive mechanism is connected to the pump mechanism; and an adapter plate arranged within the enclosure, the adapter plate having an inlet port, an outlet port, and at least one fluid passage between the inlet port and the outlet port, the at least one fluid passage being defined by the adapter plate, wherein the motor housing is thermally coupled to the adapter plate, wherein the adapter plate is planar in shape and defines a planar surface in which the at least one fluid passage is formed whereby the at least one fluid passage extends in a plane that is parallel to a plane in which the adapter plate extends, wherein the fluid outlet of the pump is fluidly connected to the inlet port of the adapter plate, the pump being configured to intake fluid from outside the enclosure through the fluid inlet and pump the fluid through the at least one fluid passage of the adapter plate, and wherein the fluid is discharged out of the enclosure directly from the outlet port of the adapter plate, wherein the at least one fluid passage of the adapter plate includes an inlet fluid passage and an outlet fluid passage that extend parallel to each other, and a transverse fluid passage that connects the inlet fluid passage and the outlet fluid passage.

15. The open pump system according to claim 14, wherein the motor housing is thermally coupled to a first side of the adapter plate and the pump housing is mounted to a second side of the adapter plate that opposes the first side.

16. The open pump system according to claim 14, wherein the motor housing has a face that engages the adapter plate and the adapter plate covers the entire area of the face.

17. The open pump system according to claim 14 further comprising a cooling fin that is adjacent the adapter plate and the motor housing.

18. The open pump system according to claim 14, wherein the at least one fluid passage is u-shaped.

19. A method for cooling a motor in a pump and motor assembly, the method comprising:

intaking a flow of fluid through a pump inlet of a pump;

discharging at least part of the flow of fluid through a pump outlet of the pump;

pumping the at least part of the flow of fluid through a fluid passage defined in an adapter plate that is fluidly connected to the pump outlet, wherein the adapter plate is in thermal contact with a motor housing that contains the motor, wherein the adapter plate defines a planar surface in which the fluid passage is formed that engages an end face of the motor housing and extends across the motor;

circulating the at least part of the flow of fluid along the end face of the motor housing in a plane that is parallel with the end face of the motor housing for cooling the motor; and discharging the at least part of the flow of fluid through a discharge passage defined in the adapter plate; and discharging the at least part of the flow of fluid from the discharge passage through an outlet port of the adapter plate that is separate from the pump outlet of the pump to discharge the at least part of the flow of fluid out of the pump and motor assembly.

* * * * *